US005778973A

United States Patent [19]

Shin

[11] Patent Number: 5,778,973

[45] Date of Patent: Jul. 14, 1998

[54] COOLING APPARATUS HAVING A SPIRALLY WOUND CONDUCTIVE PIPE

[75] Inventor: Jun-Chul Shin, Incneon, Rep. of Korea

[73] Assignee: Daewoo Electronics Co., Ltd., Seoul, Rep. of Korea

[21] Appl. No.: 798,821

[22] Filed: Feb. 12, 1997

[30] Foreign Application Priority Data

Jun. 4, 1996 [KR] Rep. of Korea ..... 1996-19755

[51] Int. Cl.[6] ..... F28F 13/12

[52] U.S. Cl. ..... 165/122; 165/163; 165/181; 416/113; 416/150

[58] Field of Search ..... 165/121, 122, 165/150, 181, 163; 62/515; 416/112, 113, 148, 150

[56] References Cited

U.S. PATENT DOCUMENTS

| | | | |
|---|---|---|---|
| 1,189,470 | 7/1916 | O'Brien | 165/122 |
| 1,566,254 | 12/1925 | Spreen | 165/121 X |
| 1,861,813 | 6/1932 | Moore | 165/121 X |
| 1,937,226 | 11/1933 | Horch | 165/121 X |
| 2,737,370 | 3/1956 | Frisch et al. | 165/181 |
| 2,962,870 | 12/1960 | Von Arb et al. | 62/515 X |
| 3,731,738 | 5/1973 | Cooper | 165/181 X |
| 4,236,578 | 12/1980 | Krieth et al. | 165/181 |

*Primary Examiner*—Leonard R. Leo
*Attorney, Agent, or Firm*—Jacobson, Price, Holman & Stern, PLLC

[57] ABSTRACT

A cooling apparatus for use in a cooling system is disclosed. The cooling apparatus comprises an evaporator having a conductive pipe which is wound spirally, and a blowing device for blowing air toward the evaporator. A plurality of fins for heat exchange are disposed on the outer surface of the conductive pipe. The blowing device has a blowing motor, a fan being rotated by the blowing motor, and a fan moving device for reciprocating the fan along the blowing direction during the rotation of the fan. Since the cool air generated from the evaporator moves with being rotated by the spirally wound conductive pipe, the air flow becomes complex and thus the heat exchange efficiency becomes high. Also, since the fan is reciprocated along the blowing direction, the blowing power is varied repeatedly and the heat exchange efficiency becomes even higher.

6 Claims, 5 Drawing Sheets

COOLING APPARATUS HAVING A SPIRALLY WOUND CONDUCTIVE PIPE

BACKGROUND OF THE INVENTION

1. Field of the Invention

The present invention relates to a cooling apparatus for use in a cooling system, and more particularly to a cooling apparatus having an evaporator with a conductive pipe which is wound spirally.

2. Prior Art

In general, a cooling system, like a refrigerator or an air conditioner, has a cooling apparatus for generating cool air. Such a conventional cooling system is shown in FIG. 1, which shows a refrigerator among the cooling systems. The refrigerator has a freezing compartment 1 and a fresh food compartment 2 which are separated from each other by a partitioning wall 3. An evaporator 4 is disposed in a cool air duct 7 which is in a back wall of the freezing compartment 1, and a compressor 6 is installed in the lower rear part of the refrigerator. A condenser (not shown) is disposed between the compressor 6 and the evaporator 4. The compressor 6 compresses refrigerant into gas having high pressure and high temperature, and the condenser condenses the gas into liquid by radiating heat from the gaseous state refrigerant. The liquid state refrigerant is supplied into the evaporator 4, and the evaporator 4 generates cool air by evaporating the refrigerant.

A blowing fan 5 is disposed on the upper side of the evaporator 4. The blowing fan 5 blows the cool air generated in the evaporator 4 into the freezing compartment 1. Accordingly, the foods in the freezing compartment 1 are frozen. Part of the cool air from the evaporator 4 is supplied into the fresh food compartment 2 through a refrigerating duct 8 disposed behind the cool air duct 7.

FIG. 2 is an enlarged view of the evaporator 4 in FIG. 1. The evaporator 4 has a conductive pipe **4*b* which is zigzag-shaped by being bent several times, and a plurality of heat exchange plates 4*a* which are disposed parallel with each other. The refrigerant supplied in the conductive pipe 4*b* evaporates in the conductive pipe 4*b* so as to absorb heat from the ambient air, and accordingly the cool air is generated around the evaporator 4. The plates 4*a* function to enhance the efficiency of heat exchange by enlarging the area which is in contact with the ambient air. The plates 4*a* are disposed parallel so that the longitudinal directions of the spaces formed thereby are in accordance with the circulating direction of the cool air formed by the blowing fan 5**.

However, such a conventional cooling apparatus has the problem that the flowing direction of the cool air is fixed in one direction by the plates **4*a* and thus the heat exchange may be performed at only a certain area of the evaporator 4. That is, since the air which is forcedly circulated by the blowing fan 5 flows along the longitudinal direction of the cool air duct 7, the flow of the cool air is simple and accordingly the blown air cannot contact uniformly with the entire area of the conductive pipe 4*b* and the plates 4*a***. Therefore, the efficiency of heat exchange becomes lowered.

SUMMARY OF THE INVENTION

The present invention has been proposed to overcome the above described problems in the prior art, and accordingly it is the object of the present invention to provide a cooling apparatus which performs the heat exchange with ambient air efficiently and accordingly has high efficiency of cooling.

To achieve the above object, the present invention provides a cooling apparatus in a cooling system having a cool air duct disposed in a wall of a cooling compartment and being communicated with the cooling compartment, the cooling apparatus comprising: an evaporator for generating cool air, the evaporator having a conductive pipe disposed in the cool air duct, the conductive pipe being wound spirally along a longitudinal direction of the cool air duct; and a means for blowing air toward the evaporator along an axial direction of the conductive pipe to provide the cooling compartment with the cool air.

It is preferable that the evaporator further comprises a plurality of fin members formed with a plurality of fins for heat exchange.

Also, it is more preferable that the blowing means comprises: a blowing motor; a fan being rotated by the blowing motor; and a means for moving the fan to be reciprocated along the axial direction when the fan is rotated, in order to enhance the efficiency of heat exchange by generating more complex air flow thereby.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
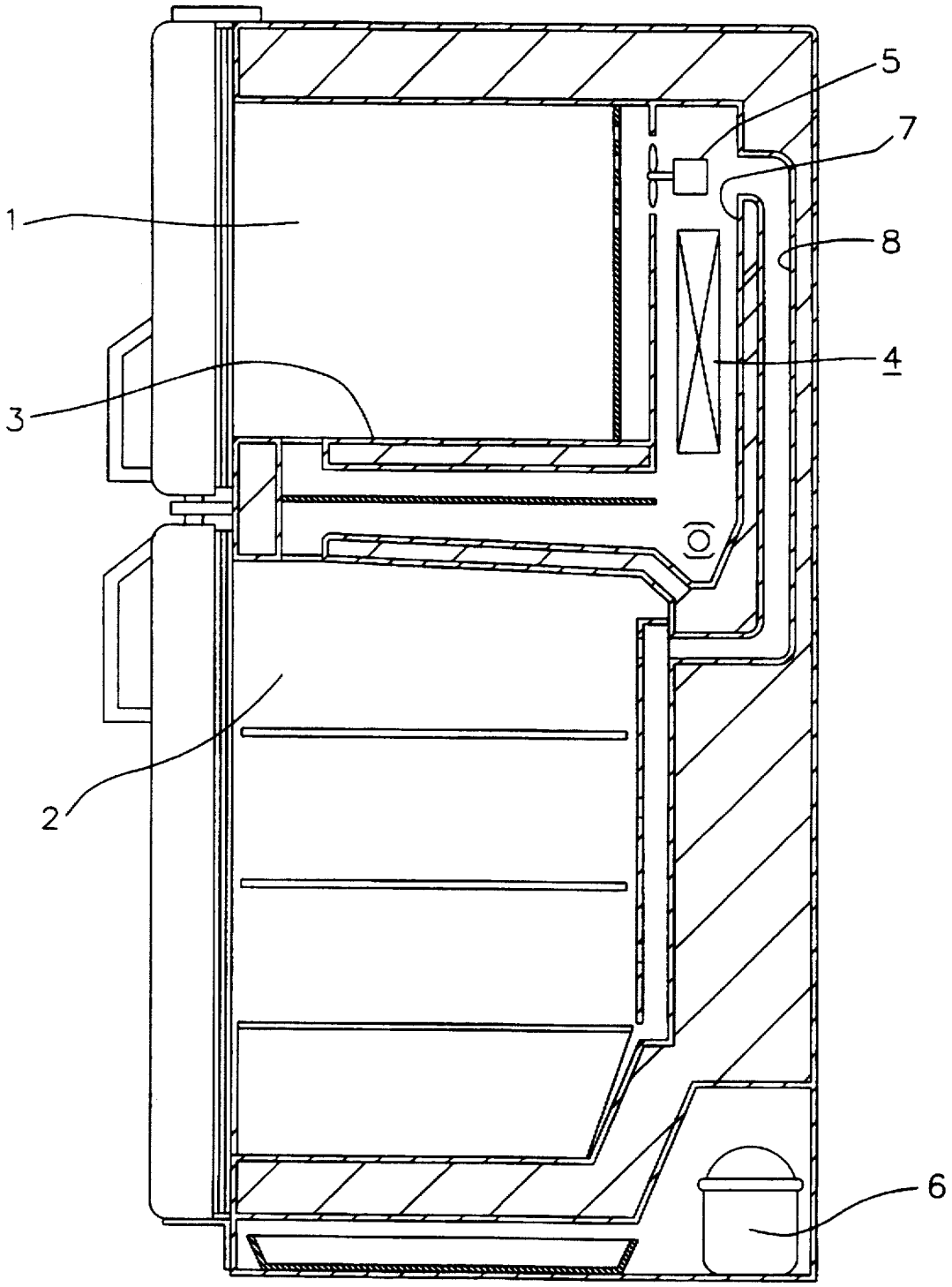
FIG. 1 PRIOR ART
FIG. 1 is a side sectional view of a refrigerator having a conventional cooling apparatus.
Figure 2:
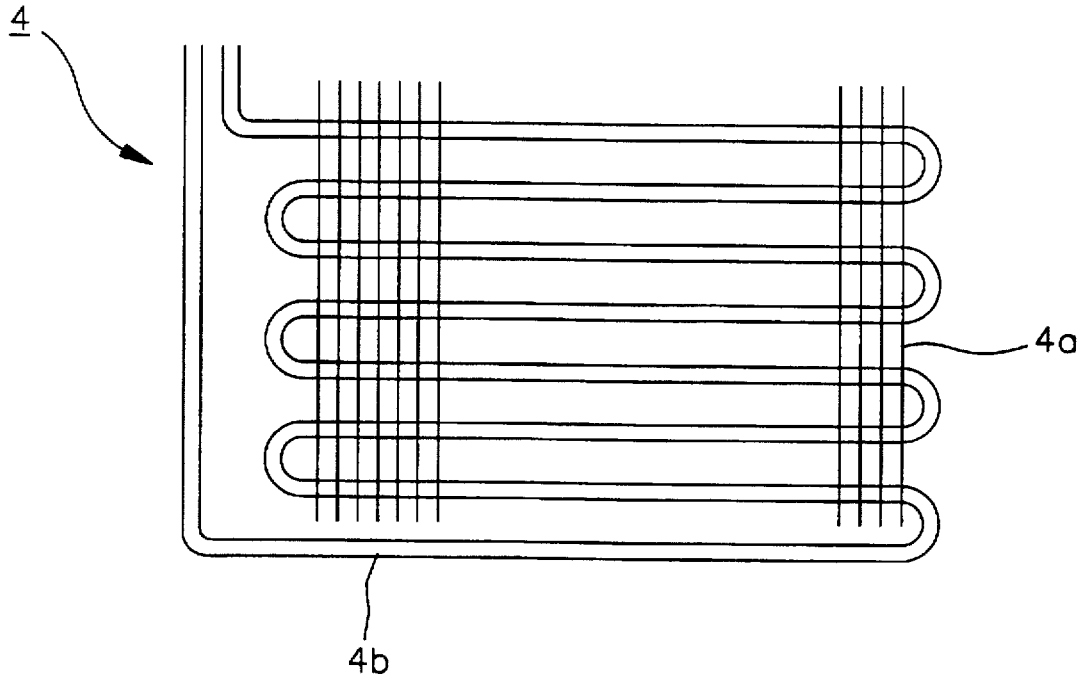
FIG. 2 is an enlarged view of an evaporator in FIG. 1.

Hereinafter, the present invention will be described in detail with reference to the drawings. In this embodiment, the situation in which the cooling apparatus according to the present invention is adopted to the refrigerator as shown in FIG. 1 is illustrated, and the elements that are the same with those in FIG. 1 are referred to by the same reference numerals.

Figure 3:
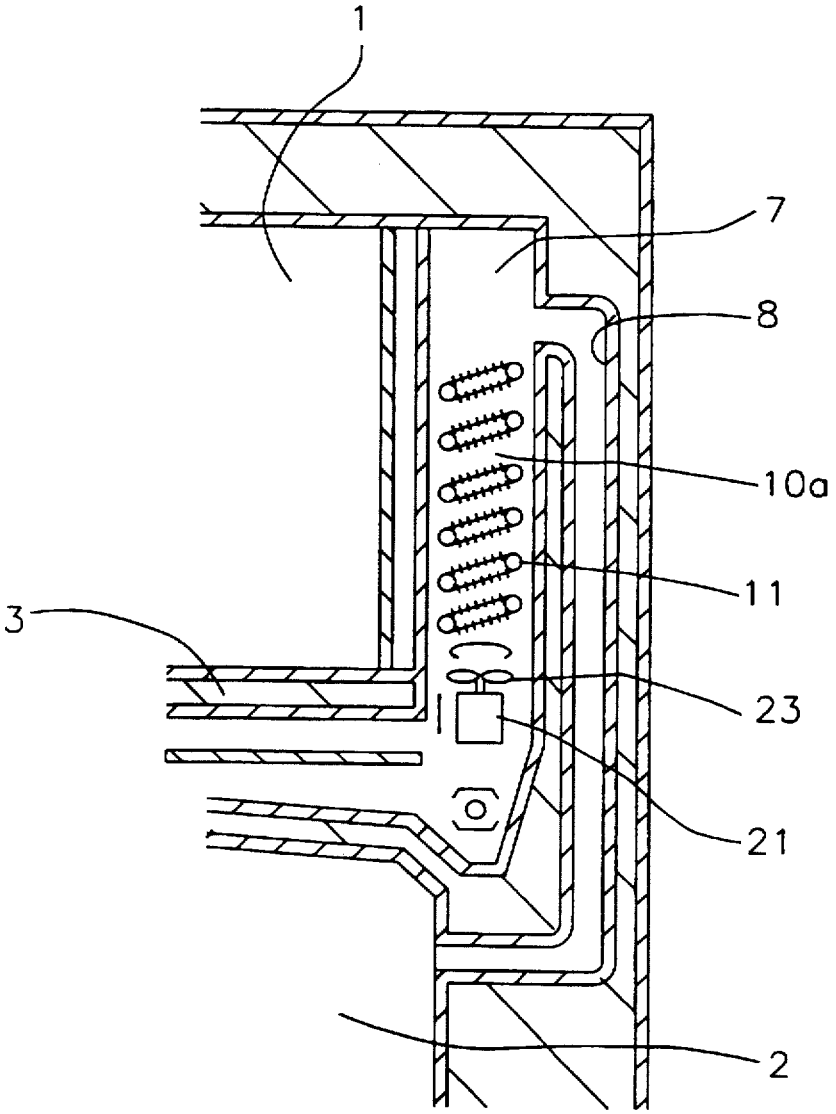
FIG. 3 is an enlarged partial side sectional view of a refrigerator having a cooling apparatus according to the present invention.
Figures 4, 4A:
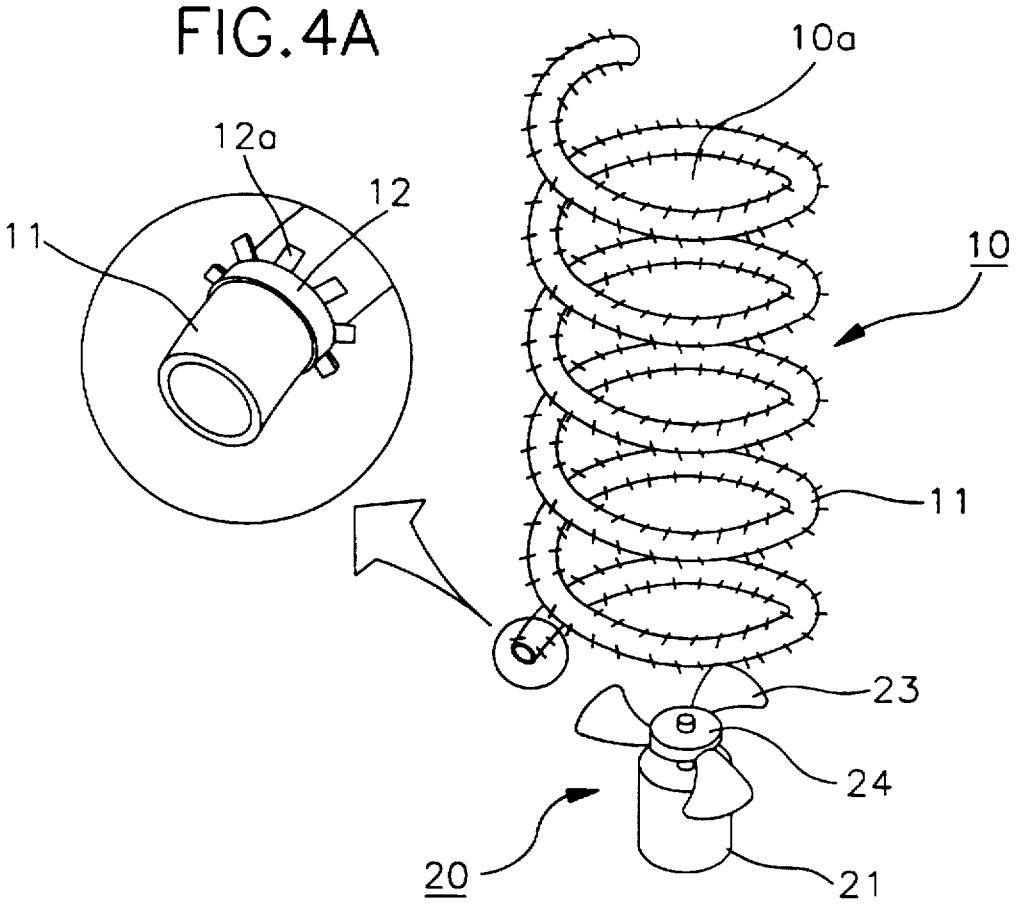
FIG. 4 is an exploded perspective view of the cooling apparatus in FIG. 3.

FIG. 3 is an enlarged partial side sectional view of a refrigerator having a cooling apparatus according to the present invention, and FIG. 4 is an exploded perspective view of the cooling apparatus in FIG. 3. The refrigerator having the cooling apparatus according to the present invention has, as the conventional refrigerator shown in FIG. 1, a freezing compartment 1 and a fresh food compartment 2 which are separated by a partitioning wall 3. In the back wall of the freezing compartment 1, a cool air duct 7 is disposed in a vertical direction. An evaporator 10 is disposed in a cool air duct 7, and a compressor (not shown) is installed in the lower rear part of the refrigerator. The compressor supplies the evaporator 10 with the compressed refrigerant which is condensed by a condenser (not shown). The evaporator 10 generates cool air by evaporating the refrigerant. Below the evaporator 10, a blowing device 20 for blowing air toward the evaporator 10 in order to supply the cool air from the evaporator 10 into the freezing compartment 1 is disposed. In the rear part of the cool air duct 7, a refrigerating duct 8 which is communicated with the fresh food compartment 2 is disposed. Part of the cool air from the evaporator 10 is supplied into the fresh food compartment 2 through the refrigerating duct 8.

The evaporator 10 has a conductive pipe 11 which is wound spirally along the longitudinal direction of said cool air duct 7. The conductive pipe 11 forms a passageway 10*a* for the cool air through which the air flows vertically. One end of the conductive pipe 11 is connected to the condenser and the other end thereof is connected to the compressor. On the outer surface of the conductive pipe 11, a plurality of fin members 12 which are formed with a plurality of fins 12*a* for heat exchange are disposed. Fin members 12 are formed to be ring-shaped, and the fins 12*a* are disposed radially on the outer surface of the fin members 12. The fin members 12 enlarge the area which comes in contact with the ambient air in order to increase the amount of heat exchange therewith.

Figure 5:
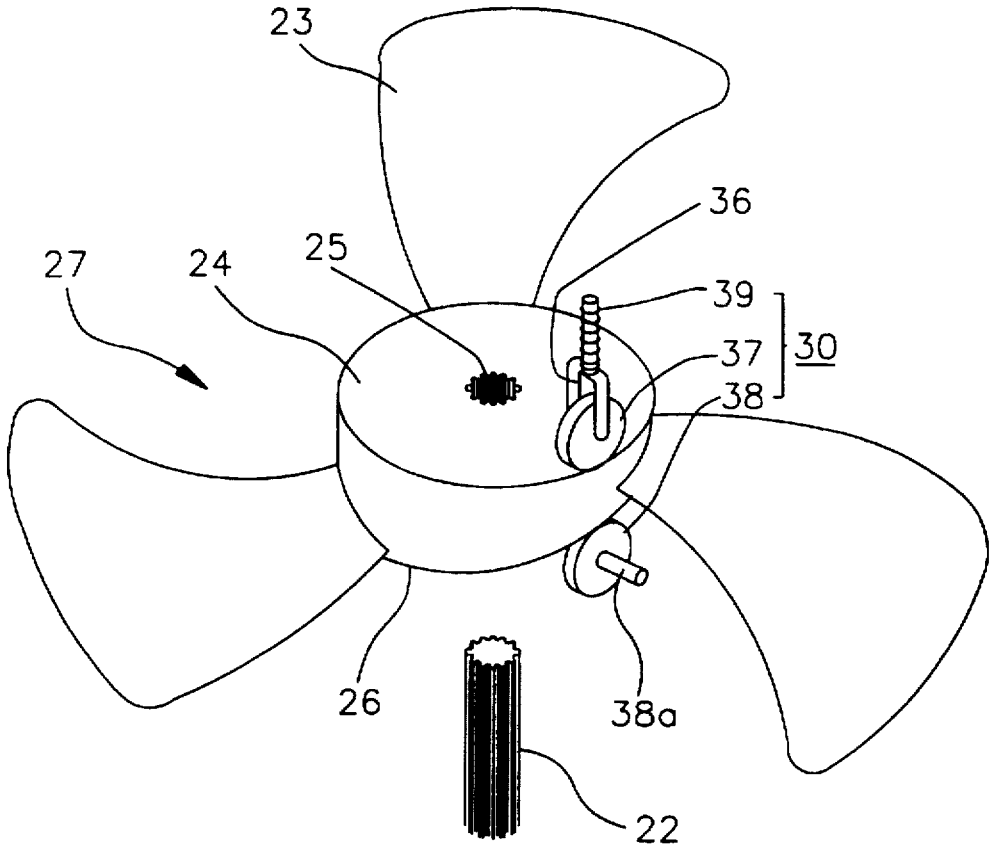
FIG. 5 is an enlarged partial perspective view of a blowing device in FIG. 4.
Figure 6:
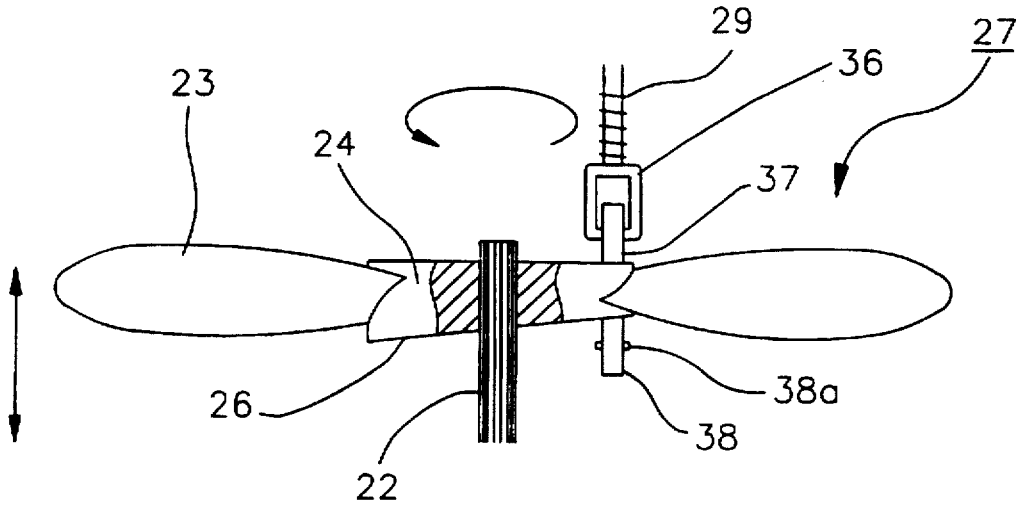
FIG. 6 is a side sectional view of an assembled state of the blowing device in FIG. 5.

FIG. 5 is an enlarged partial perspective view of a blowing device 20 in FIG. 4, and FIG. 6 is a side sectional view of an assembled state of the blowing device 20 in FIG. 5. The blowing device 20 comprises a blowing motor 21, a fan 27 being driven by the blowing motor 21 to rotate for blowing air toward the evaporator 10, and a fan moving device 30 for moving the fan 27 to be reciprocated along the blowing direction thereby.

The fan 27 has a fan hub 24 and three blowing wings 23. The fan hub 24 is formed with an throughhole 25 for being assembled with a shaft 22 of the blowing motor 21. On the periphery of the shaft 22 and the inner surface of the throughhole 25 splines are formed which are form-fitted with each other along a longitudinal direction of the shaft 22. Thus, the fan 27 is fixed to the shaft 22 with respect to the rotational direction thereof so that the fan 27 rotates together with the shaft 22, and the fan 27 becomes movable along the longitudinal direction of the shaft 22.

The fan moving device 30 comprises a fixed roller 38 supporting the lower surface 26 of the fan hub 24, a moving roller 37 supporting the upper surface of the fan hub 24, and a spring member 39 elastically pressing the moving roller 37. The lower surface 26 of the fan hub 24 is tilted at a predetermined angle with respect to the horizontal direction, so the fan hub 24 functions as a cam. The circumference of the fixed roller 38 stays in contact with the tilted side 26 in order to roll as the fan hub 24 rotates, and the shaft 38*a* of the fixed roller 38 is fixed at a predetermined position. The moving roller 37 is supported movably in vertical direction by a supporting member 36, and the circumference thereof stays in contact with the upper surface of the fan hub 24 in order to roll as the fan hub 24 rotates. The supporting member 36 is mounted movably in vertical direction, and is pressed downwardly by the spring member 39. Accordingly, the moving roller 37 stays in contact with the upper surface of the fan hub 24.

When the fan 27 begins to rotate from the state shown in FIG. 6, the fan 27 moves upwardly by the lower surface 26 of the fan hub 24 which functions as a cam and by the fixed roller 38 supporting the lower surface 26. After that situation, since the moving roller 37 presses the fan hub 24 downwardly with the elastic force of the spring member 39, the fan 27 moves downwardly as the rotation of the fan 27 continues. Accordingly, the fan 27 repeatedly reciprocates every one turn thereof.

Hereinbelow, the function and effect of the refrigerator having the cooling apparatus according to the present invention will be described.

When the refrigerator operates, the compressor begins to compress the refrigerant, and the refrigerant is compressed into gas having high temperature and high pressure. The heat of the refrigerant is radiated in the condenser so that the refrigerant becomes liquid state, and the refrigerant in liquid state is supplied into the evaporator 10. The refrigerant evaporates in the conductive pipe 11 of the evaporator 10 so as to absorb heat from ambient air in the cool air duct 7, and accordingly the cool air is generated around the conductive pipe 11. The blowing device 20 provides the cool air into the freezing compartment 1 by blowing air toward the evaporator 10. At that time, part of the cool air is provided into the fresh food compartment 2 through the refrigerating duct 8.

As described above, the air being blown by the fan 27 is changed into the cool air by heat exchange with the evaporator 10. At that time part of the air moves directly up through the passageway 10*a*, and the remaining air becomes a complex air flow since it is rotated during the movement along the wound conductive pipe 11. Accordingly, the air passing through the evaporator 10 contacts uniformly with entire area of the evaporator 10 without resulting in any uneven distribution of the contacted area. Also, the fins 12*a* which are protruded radially on the substantially entire outer surface of the conductive pipe 11 not only function to enlarge the contacting area with ambient air but also function to generate a more complex air flow, and therefore the heat exchange efficiency is increased more.

Furthermore, during the rotation of the fan 27 by the blowing motor 21, the fan moves up and down. When the fan 27 rotates with being moved up the blowing power is increased, and when the fan 27 rotates with being moved down the blowing power is decreased. Therefore, the blowing power by the blowing device 20 is varied repeatedly so that the air flow passing through the evaporator 10 becomes more complex, and the heat exchange efficiency is increased much more.

Although this embodiment illustrates the situation that the spirally wound conductive pipe 11 is adopted to the evaporator 10, it is possible to adopt such a conductive pipe 11 to a general heat exchanging apparatus like a condenser. Moreover, that can be adopted to general cooling systems, such as not only refrigerators but also air conditioners, and to other heat exchanging systems requiring heat exchange with ambient air.

As described above, according to the present invention, the cooling apparatus is provided that carries out heat exchange efficiently and therefore has high efficiency of cooling.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A cooling apparatus in a cooling system having a cool air duct disposed in a wall of a cooling compartment and being communicated with said cooling compartment, said cooling apparatus comprising:

an evaporator for generating cool air, said evaporator having a conductive pipe disposed in said cool air duct, said conductive pipe being wound spirally along a longitudinal direction of said cool air duct; and a means for blowing air toward said evaporator along an axial direction of said conductive pipe to provide said cooling compartment with the cool air, said blowing means having a blowing motor, a fan being rotated by said blowing motor, and a means for moving said fan to be reciprocated along the axial direction when said fan is rotated.

2. The cooling apparatus as claimed in claim 1, wherein said evaporator further comprises a plurality of fin members formed with a plurality of fins for heat exchange.

3. The cooling apparatus as claimed in claim 2, wherein said fin members are ring-shaped, and said fins are disposed radially on an outer surface of said fin members.

4. The cooling apparatus as claimed in claim 1, wherein said fan moving means comprises:

a fan hub being assembled to a shaft of said blowing motor, said fan hub having a side tilted at a predetermined angle with respect to a transverse direction of the blowing direction;

a fixed roller of which a shaft is fixed in position and a circumference thereof is in contact with the tilted side so as to roll as said fan hub rotates; and a means for elastically pressing said fan hub against a moving direction thereof by said fixed roller.

5. The cooling apparatus as claimed in claim 5, wherein said pressing means comprises:

a moving roller of which a shaft is mounted movably along the axis direction and a circumference thereof is in contact with a rear side of the tilted side so as to roll as said fan hub rotates; and a spring member for elastically pressing said moving roller in a direction for contacting of said moving roller with the rear side of the tilted side.

6. A cooling apparatus in a cooling system having a cool air duct disposed in a wall of a cooling compartment and being communicated with said cooling compartment, said cooling apparatus comprising:

an evaporator for generating cool air, said evaporator having a conductive pipe disposed in said cool air duct, said conductive pipe being wound spirally along a longitudinal direction of said cool air duct, and a plurality of fin members formed with a plurality of fins for heat exchange; and a blowing device for blowing toward said evaporator along an axial direction of said conductive pipe to provide said cooling compartment with the cool air, said blowing device having a blowing motor, a fan being rotated by said blowing motor and having a fan hub of which a side is tilted at a predetermined angle with respect to a transverse direction of the blowing direction, a fixed roller of which a shaft is fixed in position and a circumference thereof is in contact with the tilted side so as to roll as said fan hub rotates, a moving roller of which a shaft is mounted movably along the axis direction and a circumference thereof is in contact with a rear side of the tilted side so as to roll as said fan hub rotates, and a spring member for elastically pressing said moving roller in a direction for contacting of said moving roller with the rear side of the tilted side.

* * * * *